US007518064B2

(12) United States Patent
Morioka et al.

(10) Patent No.: US 7,518,064 B2
(45) Date of Patent: Apr. 14, 2009

(54) HALOGEN FREE FLAME RETARDANT CABLE

(75) Inventors: Tsunenori Morioka, Osaka (JP); Hiroshi Hayami, Osaka (JP); Kazuto Shiina, Kanuma (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/566,368

(22) PCT Filed: Jul. 27, 2004

(86) PCT No.: PCT/JP2004/011185

§ 371 (c)(1),
(2), (4) Date: Sep. 18, 2007

(87) PCT Pub. No.: WO2005/013291

PCT Pub. Date: Feb. 10, 2005

(65) Prior Publication Data

US 2008/0105454 A1 May 8, 2008

(30) Foreign Application Priority Data

Jul. 30, 2003 (JP) ..... 2003-203505

(51) Int. Cl.
*H01B 9/02* (2006.01)

(52) U.S. Cl. ..... 174/120 R; 174/121 A

(58) Field of Classification Search ..... 174/120 R, 174/120 SR, 121 A

See application file for complete search history.

(56) References Cited

U.S. PATENT DOCUMENTS 5,718,974 A * 2/1998 Kmiec ..... 428/383

(Continued)

FOREIGN PATENT DOCUMENTS

CN 85101465 A 1/1987

(Continued)

OTHER PUBLICATIONS

Chinese Office Action issued in Chinese Patent Application No. CN 2004-80022095.1 dated on Mar. 28, 2008.

(Continued)

*Primary Examiner*—Chau N Nguyen
(74) *Attorney, Agent, or Firm*—McDermott Will & Emery LLP

(57) ABSTRACT

A halogen free flame retardant cable that has excellent flexibility and abrasion resistance, exhibiting fusion adhesion property to mold materials, such as PBT and nylon, and excellent flame retardant property, preferably having abrasion resistance. In particular, there is provided a halogen free flame retardant cable characterized in that it includes an insulating wire, an inner sheath and an outer sheath, the inner sheath comprised of a polyolefin resin or a resin composition composed mainly of the resin, the outer sheath comprised of a product of crosslinking of a mixture of thermoplastic polyurethane elastomer and thermoplastic polyester elastomer or a resin composition composed mainly of the mixture, the outer sheath containing at least one flame retardant selected from among metal hydroxides and nitrogenous flame retardants in an amount of 3 to 35 parts by weight per 100 parts by weight of the resin mixture. Further, there is preferably provided a halogen free flame retardant cable wherein the inner sheath contains a specified flame retardant in an amount of specified range.

12 Claims, 1 Drawing Sheet

U.S. PATENT DOCUMENTS

| | | | | |
|---|---|---|---|---|
| 6,242,097 | B1 * | 6/2001 | Nishiguchi et al. | 428/383 |
| 6,403,889 | B1 * | 6/2002 | Mehan et al. | 174/120 R |
| 6,436,557 | B1 | 8/2002 | Moriuchi et al. | |

FOREIGN PATENT DOCUMENTS

| | | | | |
|---|---|---|---|---|
| CN | 1229422 | A | | 9/1999 |
| EP | 0919 591 | A1 | | 6/1999 |
| EP | 1 043 733 | A1 | | 10/2000 |
| JP | 07078518 | | * | 3/1995 |
| JP | 10-177818 | | | 6/1998 |
| JP | 10-233124 | | | 9/1998 |
| JP | 10-233125 | | | 9/1998 |
| JP | 2000-219814 | | | 8/2000 |
| JP | 2001-089614 | | | 4/2001 |
| JP | 2001-302851 | | | 10/2001 |
| JP | 2001-312925 | | | 11/2001 |
| JP | 2002-163940 | | | 6/2002 |

OTHER PUBLICATIONS

European Search Report issued in Patent Application No. 04771220.3—1231 dated on Sep. 15, 2008.

Chinese Office Action, with English translation, issued in Chinese Patent Application No. CN 200480022095.1 dated on Sep. 19, 2008.

* cited by examiner

HALOGEN FREE FLAME RETARDANT CABLE

RELATED APPLICATION

This application is a national phase of PCT/JP2004/011185 filed on Jul. 27, 2004, which claims priority from Japanese Application No. 2003-203505 which was filed on Jul. 30, 2003, the disclosures of which Applications are incorporated by reference herein. The benefit of the filing and priority dates of the International and Japanese Applications is respectfully requested.

FIELD OF THE INVENTION

The present invention relates to a halogen free flame retardant insulated cable which does not contain any substance that is suspected as to be as a not eco-friendly material; and, more particularly, to a halogen free flame retardant cable for an automobile antilock brake system (ABS) application and the like.

BACKGROUND OF THE INVENTION

In order to improve a driving safety, various control systems, e.g., ABS, are equipped to automobile in recent years. The ABS is comprised of a wheel speed sensor to detect a rotation speed of a wheel, an electric control unit (ECU) to measure a signal generated by the wheel speed sensor and an actuator that is operated by an output signal from the ECU, wherein the brake is controlled by an operation of the actuator.

The signal from the wheel speed sensor is transmitted to the ECU via an ABS sensor cable. Normally, the ABS sensor cable consists of twisted pair of insulated wires, the external circumferential surface thereof being covered by an intermediate filler material for securing the integrity of the circular cross sectional structure of the cable, and then covering the external circumferential surface of the intermediate filler material with a sheath. FIG. 1 is a cross sectional view of an embodiment of a halogen free flame retardant cable in accordance with the present invention that is cut along a surface perpendicular to the longitudinal direction of the cable. A conventional ABS sensor cable also has a similar structure.

The wheel speed sensor is installed near the wheel and exposed to a severe environment, such as water splash and ice coating and is required that the seal between the ABS sensor cable and wheel speed sensor is waterproof. Therefore, after the ABS sensor cable is connected to the wheel speed sensor, the entirety thereof is molded with a plastic resin such as polybutyleneterephthalate (PBT), nylon or the like.

Preferably, a certain material having a heat adhesion property to the molding material such as PBT or nylon may be used to manufacture the sheath covering the cable to provide a high seal performance without having to use a seal member such as an O-ring or the like, thereby reducing the manufacturing cost thereof, while ensuring the waterproofness. In addition, the sheath material is required to have an abrasion resistance, flexibility, superior mechanical strength and the like. A mixture of a thermoplastic polyurethane elastomer and a thermoplastic polyester elastomer, due to its excellent heat adhesion property to the molding material, the mechanical strength and the like, has been used in manufacturing the sheath (see, e.g., Japanese Patent Laid-open Application No. 10-177818, Claim 1).

On the other hand, since the wire and the cable for use in an automobile are required to have a flame-retardant property, the ABS sensor cable need be made of a material having a flame-retardant property. A mixture of a thermoplastic polyurethane elastomer and a thermoplastic polyester elastomer is normally flammable and cannot meet the flame-retardant property requirement stipulated by the JASO standard for a wire product for use in an automobile. As an effort to overcome the deficiency, therefore, a halogenated flame retardant such as a chloride or bromide type has been added to the thermoplastic mixture employed to manufacture the sheath.

With the increasing awareness of environmental problems in recent years, it is considered that utilization of halogenated flame retardants for flame retardation of polymers is not so suitable selection for realizing environmental friendly society. Because polymer wastes that contain halogenated flame retardant generate harmful substance such as hydrogen halide, and sometimes generate dioxin in certain condition when they are disposed by incineration. From the view point of above mentioned background, the development of a halogen free flame retardant heat adhesion type of ABS sensor cable is demanded. Despite various efforts, however, the industry has failed to produce a halogen free flame retardant having a flame-retardant property compatible to that of a halogenated flame retardant. Also, the use of a large amount of a flame retardant to ensure a high level of flame-retardant property tends to deteriorate the heat adhesion property, abrasion resistance and the like of the sheath.

SUMMARY OF THE INVENTION

As discussed above, there has existed a need for the development of a cable having satisfactory flexibility, mechanical strength, excellent heat adhesion property to a molding material such as PBT and nylon, and excellent flame-retardant property and, especially excellent abrasion resistance, in addition to the fundamental characteristics required to perform the basic function of an ABS sensor cable, without using a halogenated flame retardant which is not eco-friendly material.

It is, therefore, an object of the present invention to provide a halogen free flame retardant cable without using a halogenated flame retardant which is not eco-friendly material, which is capable of offering an excellent flexibility, mechanical strength, heat adhesion property to a molding material such as PBT or nylon, flame-retardant property, and, in particular, abrasion resistance.

The inventors have found that it is possible to obtain a halogen free flame retardant cable satisfying all of the characteristics mentioned above, by adding at least one flame retardant selected from the group consisting of metal hydroxides and flame retardants containing nitrogen atom in a molecule in an amount of specified range to a composition used to manufacture a sheath (which shall be called an "outer sheath" hereinafter for the sake of clarity) and simultaneously providing an inner sheath comprised of a polyolefin based resin between the outer sheath and an insulated wire. The halogen free flame retardant cable has an excellent flexibility, mechanical strength, heat adhesion property to a molding material such as PBT or nylon and flame-retardant property. Further, the inventors have made the present invention based on the discovery that the inventive halogen free flame retardant cable having an excellent abrasion resistance can be produced by introducing into the inner sheath a flame retardant consisting of aluminum hydroxide and/or magnesium hydroxide in an amount of specified range.

A preferred embodiment of the present invention, as set forth in claim 1, provides a halogen free flame retardant cable that includes at least one insulated wire, an inner sheath covering the insulated wire and an outer sheath covering the inner sheath, wherein the inner sheath comprises a polyolefin based resin or a resin composition comprised mainly of the polyolefin based resin, the outer sheath includes a crosslinked resin mixture of a thermoplastic polyurethane elastomer and a thermoplastic polyester elastomer or a crosslinked resin composition composed mainly of the mixture, and the outer sheath contains at least one flame retardant selected from the group consisting of metal hydroxides and flame retardants containing nitrogen atom in a molecule in an amount of 3~35 parts by weight per 100 parts by weight of the crosslinked polymer blend.

FIG. 1 is a cross sectional view of an embodiment of a halogen free flame retardant cable in accordance with the present invention that is cut along a surface perpendicular to the longitudinal direction of the cable. As shown in FIG. 1, the halogen free flame retardant cable of the present invention is comprised of at least one insulated wire (1), an inner sheath (2) covering the insulated wire and an outer sheath (3) covering the inner sheath. The insulated wire (1) consists of a conductor (4) disposed in a center thereof and an insulator (5) covering the conductor.

In FIG. 1, there are two insulated wires (1) which are stranded together. In case that the cable is used as the ABS sensor cable, two insulated wires (1) are normally needed.

Another preferred embodiment of the present invention (claim 2) is directed to a halogen free flame retardant cable having the above construction, wherein the insulated wires are fabricated by stranding a plurality of insulated wires.

The inner sheath (2) covers the insulated wires (1) to enhance the flame-retardant performance of the cable. In case the two insulated wires (1) are stranded to form, e.g., an ABS sensor cable, the inner sheath (2) also corresponds to the intermediate filler material employed in a conventional ABS sensor cable, and serves the function of the conventional intermediate filler material to secure the circular cross-sectional structure of the cable.

Furthermore, the inner sheath (2) is covered with the outer sheath (3). The cable having such configuration may be fabricated by extruding the inner sheath (2) over the insulated wires (1) and then extruding the outer sheath (3) over the extruded inner sheath (2).

The halogen free flame retardant cable of the present invention has the structure as described above and also has the technical features itemized as 1), 2) and 3) below.

1) The inner sheath is comprised of a polyolefin based resin or a resinous composition mainly composed of the polyolefin based resin.

2) The outer sheath is comprised of a crosslinked resin mixture of a thermoplastic polyurethane elastomer and a thermoplastic polyester elastomer or a crosslinked resin composition mainly composed of the mixture.

3) The outer sheath contains at least one flame retardant selected from the group consisting of metal hydroxides and flame retardants containing nitrogen atom in a molecule in an amount of 3~35 parts by weight per 100 parts by weight of the crosslinked product.

Each of these respective features will be explained below.

If the inner sheath, which corresponds to the intermediate filler material of the conventional ABS sensor cable, is made of a polyolefin based resin, the halogen free cable made therewith can have an excellent flame-retardant property.

The thermoplastic polyurethane elastomer or the thermoplastic polyester elastomer used in the outer sheath has also been used as the intermediate filler material in the conventional ABS sensor cable. However, when these elastomers are used in the inner sheath, the heat adhesion property to the molding material, such as PBT or nylon, of the outer sheath may become insufficient due to the use of a large amount of a flame retardant in the outer sheath in order to secure the flame-retardant property.

In addition, if the inner sheath is comprised of a thermoplastic polyurethane elastomer or a thermoplastic polyester elastomer, it becomes difficult to obtain the sufficient flame-retardant property required for the cable even though a large quantity of a flame retardant is added to the inner sheath so as to assist the insufficient flame-retardant property of the outer sheath. For example, it would be difficult to obtain a sufficient flame-retardant property even when a metal hydroxide flame retardant or flame retardant containing nitrogen atom in a molecule is added to the inner sheath resin in an amount of 100 parts by weight per 100 parts by weight of the resin.

The present inventors have found that a halogen free cable having an excellent flame-retardant property can be obtained by using a polyolefin based resin or a resin composition mainly composed of the polyolefin based resin to form the inner sheath, even if a large amount of flame retardant is not used in the outer sheath, thereby ensuring the outer sheath to have an excellent heat adhesion property to the molding material.

Although it is not essential for the inner sheath to contain a flame retardant in order to produce a cable having an excellent flame-retardant property and heat adhesion property, it is preferable to have a flame retardant therein to increase the flame-retardant property and the heat adhesion property of the cable. By adding the flame retardant to the inner sheath, the amount of a flame retardant used in the outer sheath can be reduced, thereby advantageously attaining such properties as excellent heat adhesion property and mechanical strength, as demonstrated by the ability to prevent crack formation in a low temperature bending test conducted at −40° C.

Especially, it is more preferable to include, in the inner sheath, aluminum hydroxide and/or magnesium hydroxide as the flame retardant in an amount of 30~120 parts by weight per 100 parts by weight of the polyolefin based resin in order to obtain a halogen free flame retardant cable having excellent abrasion resistance in addition to the above advantageous characteristics. If the amount of a flame retardant used in the inner sheath is less than 30 parts by weight, the flame-retardant property and the heat adhesion property may not be sufficiently improved. On the other hand, if the amount is more than 120 parts by weight, the abrasion resistance would decrease. Therefore, the amount of a flame retardant which may be employed in an inner sheath is preferably kept to a level less than 120 parts by weight.

Claim 3 is directed to another preferred embodiment of the present invention that provides a halogen free flame retardant cable, wherein the inner sheath includes a flame retardant composed of aluminum hydroxide and/or magnesium hydroxide in an amount of 30~120 parts by weight per 100 parts by weight of the polyolefin based resin.

The amount of the flame retardant employed in the inner sheath may range, more preferably, from 50 to 100 parts by weight. By adjusting to this range, the heat adhesion property, flame-retardant property and abrasion resistance of the cable can be further secured.

Claim 4 is directed to another preferred embodiment of the present invention that provides a halogen free flame retardant cable, wherein the inner sheath contains a flame retardant in an amount of 50~100 parts by weight per 100 parts by weight of the polyolefin based resin.

The flame retardant included in the inner sheath may be aluminum hydroxide and/or magnesium hydroxide; however, aluminum hydroxide is more preferred.

Claim 5 is directed to another preferred embodiment of the present invention that provides a halogen free flame retardant cable, wherein the flame retardant included in the inner sheath is aluminum hydroxide.

If the flame retardant included in the inner sheath has an average particle diameter of 0.9 μm or less, the flame retardant effect tends to be more enhanced. However, if the average particle diameter is too small, it may cause a cohesion among the particles, and, consequently, leads to handling difficulties. Therefore, the average particle diameter of a flame retardant may preferably range from 0.1 to 0.9 μm. The average particle diameter within the range is preferred in that the problem related to the handling difficulty is prevented while excellent flame retardant effect is attained.

Claim 6 is directed to another preferred embodiment of the present invention that provides a halogen free flame retardant cable, wherein the flame retardant included in the inner sheath has an average particle diameter of 0.1~0.9 μm.

The polyolefin based resin used in the inner sheath may include polyethylene, an ethylene vinyl acetate copolymer (EVA), ethylene acrylic ester copolymers such as an ethylene ethyl acrylate copolymer (EEA), an ethylene α-olefin copolymer, an ethylene methyl acrylate copolymer, an ethylene butyl acrylate copolymer, an ethylene methyl methacrylate copolymer, an ethylene acrylate copolymer, a partially saponificated EVA, a maleic acid anhydride modified polyolefin, an ethylene acrylic ester maleic acid anhydride copolymer and the like, which may be used alone or in a mixture thereof in the inner sheath.

Among the above resins, the ethylene vinyl acetate copolymer (EVA) and the ethylene ethylacrylate copolymer (EEA) are preferred; and the ethylene vinyl acetate copolymer (EVA) is more preferred due to its higher mechanical strength and excellent abrasion resistance.

Claim 7 relates to another preferred embodiment of the inventive halogen free flame retardant cable, wherein the polyolefin based resin included in the inner sheath is an ethylene vinyl acetate copolymer.

The present invention provides another preferred embodiment, as cited in claim 8, of halogen free flame retardant cable, wherein the polyolefin based resin included in the inner sheath contains an acid-modified polymer. Replacing only a part by weight of the polyolefin based resin with the acid-modified polymer may enhance the abrasion resistance of the cable.

As the acid-modified polymer, there may be used any polyolefin based resin that is graft-modified with a carboxylic acid or a carboxylic acid anhydride, or a copolymer of an olefin with acrylic acid or maleic acid anhydride or the like, with the latter being more preferred due to its high degree of acid-modification. Even when the content of the flame retardant is 180 parts by weight, a mixture of an ethylene ethylacrylate copolymer (EEA) and an ethylene acrylic ester maleic acid anhydride terpolymer successfully passes a low temperature bending test at −40° C. and, at the same time, exhibits a high flame-retardant property, thereby reducing the amount of the flame retardant to be used in the outer sheath, and, consequently, achieving a high heat adhesion property of the outer sheath.

The inner sheath preferably contains a silane coupling agent in an amount of 0.1~3 parts by weight per 100 parts by weight of the polyolefin based resin, to thereby further enhance the abrasion resistance.

Claim 9 is directed to another preferred embodiment of the present invention which provides a halogen free flame retardant cable, wherein the inner sheath includes a silane coupling agent in an amount of 0.1~3 parts by weight per 100 parts by weight of the polyolefin based resin.

Representative silane coupling agents which may be used in this preferred embodiment include triethoxy vinyl silane, trimethoxy vinyl silane, 3-methacryloxy propyl trimethoxy silane, 3-amino propyl trimethoxy silane, N-(2-aminoethyl)-3-aminopropyl trimethoxy silane, 3-glycidoxypropyl trimethoxy silane, 3-mercaptopropyl trimethoxy silane and the like.

As discussed previously, a second feature of the present invention resides in that the outer sheath is comprised of a crosslinked resin mixture of a thermoplastic polyurethane elastomer and a thermoplastic polyester elastomer. It is possible to obtain an excellent heat adhesion property to a molding material such as PBT or nylon by using such a crosslinked resin mixture in the outer sheath.

Exemplary thermoplastic polyurethane elastomers which may be used in the present invention include a block copolymer having a polyurethane part, as a hard segment, obtained from a diisocyanate such as diphenylmethane diisocyanate (MDI) or tolylene diisocyanate (TDI) and a diol such as ethylene glycol, and an amorphous polymer such as polyether, polyester or polycarbonate, as a soft segment. A polyether-based thermoplastic polyurethane elastomer may be preferably used due to its flexibility, hydrolysis resistance and low temperature bending characteristics and so on.

On the other hand, suitable thermoplastic polyester elastomers which may be need in the present invention include a block copolymer having a crystalline polyester part, as a hard segment, such as polybutyleneterephthalate and polybutylenenaphthalate and the like, and an amorphous or low crystalline polymer, as a soft segment, such as polyether, polycaprolactone and the like. A polyether based thermoplastic polyester elastomer is preferred due to its good flexibility and low temperature bending characteristics and so on.

The present invention, as cited in claim 10, provides another preferred embodiment of halogen free flame retardant cable, wherein the weight ratio of the thermoplastic polyurethane elastomer to the thermoplastic polyester elastomer ranges from 20/80 to 80/20.

The mixing ratio of the thermoplastic polyurethane elastomer and the thermoplastic polyester elastomer ranges preferably from 20/80 to 80/20 by weight. If the proportion of the thermoplastic polyester elastomer is higher, the heat adhesion property to the molding material will become higher; whereas a higher proportion of the thermoplastic polyurethane elastomer may be preferred if a higher strength of the material is desired. The mixing ratio of the thermoplastic polyurethane elastomer and the thermoplastic polyester elastomer within the above specified range is preferred because both excellent heat adhesion property to the molding material and the strength of the cable can be attained. The mixing ratio of the thermoplastic polyurethane elastomer and the thermoplastic polyester elastomer may range, more preferably, from 40/60 to 60/40 by weight.

The present invention provides, in claim 11, another preferred embodiment of halogen free flame retardant cable, wherein at least the outer sheath is irradiated by an ionizing radiation.

The outer sheath is comprised of a product obtained by crosslinked resin mixture of a thermoplastic polyurethane elastomer and a thermoplastic polyester elastomer. The crosslinking may prevent deformation of the outer sheath during a resin molding process, thereby making the outer sheath suitable for the manufacture of a resin molded ABS sensor cable.

A chemical crosslinking by using a crosslinking agent may also be employed; however, the irradiation method is more preferred due to the easy control of the degree of crosslinking. Claim 11 relates to such preferred embodiment.

The ionizing radiation method may employ high energy electron beam, ionization particle ray, X-ray, γ-ray and the like; and the electron beam method is preferred due to its easy control or handling. The exposure dose of electron beam may preferably range from 10 to 400 kGy. An exposure dose less than 10 kGy tends to make the outer sheath to be deformed in the resin molding process. On the other hand, if the exposure dose is more than 400 kGy, the heat adhesion property tends to decrease. By controlling the exposure dose within the above-specified range, deformation of the outer sheath can be prevented and excellent heat adhesion property can be achieved. In addition, within the above range of the exposure dose, the inner sheath may also be crosslinked.

As described previously, a third feature of the present invention resides in that the outer sheath may contain at least one flame retardant selected from the group consisting of metal hydroxides and flame retardants containing nitrogen atom in a molecule in an amount of 3~35 parts by weight per 100 parts by weight of the crosslinked product.

If the content of the flame retardant is less than 3 parts by weight per 100 parts by weight of the crosslinked product, it would be difficult to obtain a sufficient flame-retardant property. On the other hand, if the content of the flame retardant exceeds 35 parts by weight, the outer sheath may exhibit an insufficient heat adhesion property to the molding material.

The present invention, as cited in claim 12, provides another preferred embodiment of halogen free flame retardant cable, wherein the amount of the flame retardant included in the outer sheath ranges from 5 to 22 parts by weight per 100 parts by weight of the crosslinked resin mixture. The content of the flame retardant in the outer sheath is preferably 5~22 parts by weight per 100 parts by weight of the crosslinked resin mixture because it is possible to achieve both excellent flame-retardant property and heat adhesion property within the specified range.

The metal hydroxide included in the outer sheath can be aluminum hydroxide or magnesium hydroxide. The flame retardant containing nitrogen atom in a molecule can be melamine, melamine cyanurate, melamine phosphate or the like.

Magnesium hydroxide is preferred as the metal hydroxide; and melamine cyanurate is preferred as the flame retardant containing nitrogen atom.

Claim 13 relates to another preferred embodiment of the present invention which provides a halogen free flame retardant cable, wherein the flame retardant included in the outer sheath is selected from the group consisting of magnesium hydroxide and melamine cyanurate.

Additives usually added to a resin, such as an antioxidant, an stabilizer agent, a coloring pigment, a crosslinking agent, a tackifier, a lubricant, a softener, a filler, a processing aid and a coupling agent and the like, may be introduced to the resin or the resinous composition which is employed to form the outer sheath or the inner sheath.

As the antioxidant, a phenol based antioxidant, an amine based antioxidant, a sulfur based antioxidant and a phosphate ester based antioxidant or the like may be used.

As the stabilizer agent, a HALS (hindered amine-based light stabilizer), a UV absorbent, a metal deactivating agent and an anti-hydrolysis agent or the like can be used.

As the coloring pigment, an organic or inorganic pigment such as carbon black, titanium white or the like can be used. They can be added to distinguish colors or absorb UV light.

Although the use of a crosslinking agent is not essential to carry out the crosslinking, it is preferable to add a crosslinking agent in an amount of 1~10 parts by weight to enhance the crosslinking efficiency. Useful crosslinking agents may include triallyl isocyanurate, trimethyrol propane trimethacrylate, N,N'-metaphenylene bismaleimide, ethylene glycol dimethacrylate, zinc acrylate, zinc methacrylate and the like.

Tackifiers which may be used in the present invention include a cumaron-indene resin, a polyterpene resin, a xylene-formaldehyde resin, a hydrogenated rosin and the like. As the lubricant, a fatty acid, unsaturated fatty acid, metal salts thereof, fatty acid amide, fatty acid ester and the like can be used. As the softener, mineral oil, vegetable oil, plasticizer and the like can be used. As the filler, calcium carbonate, talc, clay, silica, zinc oxide, molybdenum oxide and the like can be used. As the coupling agent, a titanate based coupling agent such as isopropyl triisostearoyl titanate, isopropyl tri(N-aminoethyl-aminoethyl) titanate can be added, if necessary, in addition to the silane coupling agent.

As previously explained, the halogen free flame retardant cable of the present invention does not include any halogenated materials, and has excellent mechanical strength, heat adhesion property to a molding material such as PBT or nylon, and flame-retardant property. Furthermore, the inventive halogen free flame retardant cable exhibits excellent abrasion resistance, when the inner sheath is comprised of a flame retardant, e.g., aluminum hydroxide and/or magnesium hydroxide, in an amount of 30~120 parts by weight per 100 parts by weight of the polyolefin based resin. The halogen free flame retardant cable of the present invention having such excellent characteristics can be utilized in an ABS sensor cable and the like.

BRIEF DESCRIPTION OF THE DRAWING

The above and other objectives and features of the present invention will become apparent from the following description of preferred embodiments given in conjunction with FIG. 1 which shows a cross sectional view of a halogen free flame retardant cable in accordance with the present invention.

DETAILED DESCRIPTION OF THE PREFERRED EMBODIMENTS

Figure 1:
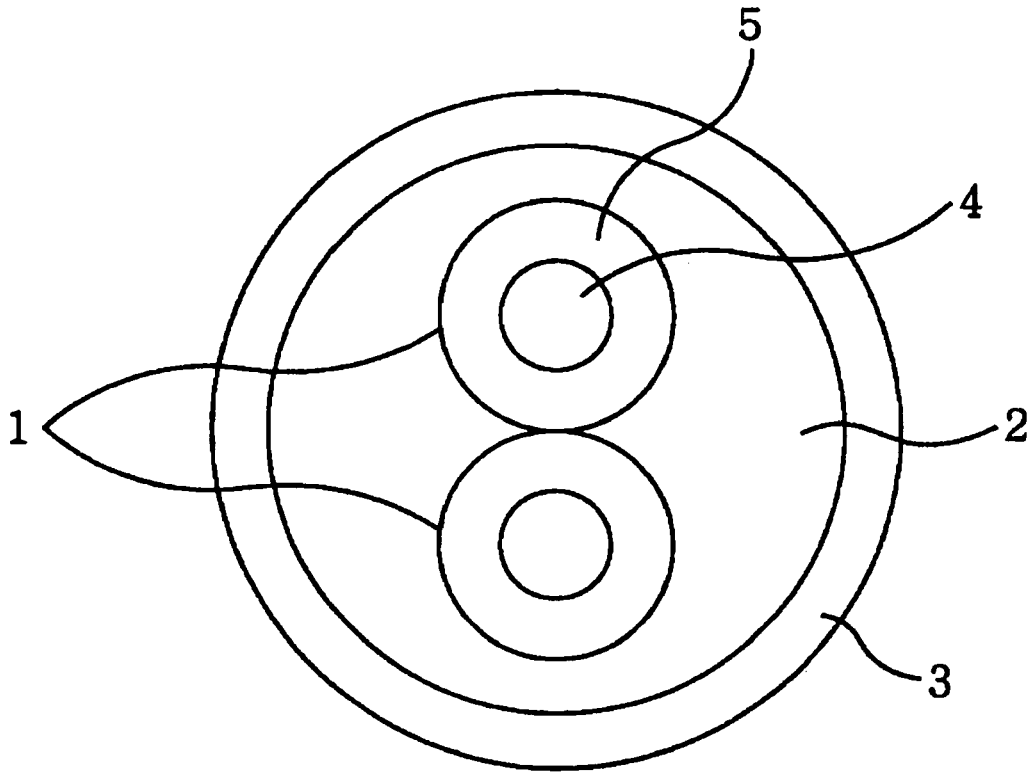

The present invention will be described in detail with respect to the preferred embodiments. However, it should be noted that the present invention is not limited thereto.

EXAMPLES

Manufacture of an Outer Sheath Material

The compositions for an outer sheath material as shown in Tables 1 to 6 were melt-extruded using a twin screw extruder (barrel diameter 45 mm, L/D=32), and the extruded strands were cut with a water-cooling cutting method to obtain pellet-shaped materials for use to form the outer sheath.

Manufacture of an Inner Sheath Material

The compositions for an inner sheath material as shown in Tables 1 to 6 were melt-extruded using a twin screw extruder (barrel diameter 45 mm, L/D=32), and the extruded strands were cut with a water-cooling cutting method to obtain pellet-shaped materials for use to form the inner sheath.

Manufacture of an Insulated Wire

A resin composition composing 100 parts by weight of linear low density polyethylene (LLDPE; m.p. 122° C., melt flow rate 1.0), 80 parts by weight of magnesium hydroxide (average particle diameter 0.8 μm, BET specific surface area 8 $m^2/g$) as a flame retardant, 0.5 part by weight of Irganox 1010 (Chiba Speciality Chemicals Inc.), and 3 parts by weight of trimethyrolpropane trimethacrylate was melt-extruded using a twin screw extruder (barrel diameter 45 mm, L/D=32), and the extruded strands were cut with a water-cooling cutting method to obtain pellets.

The pellets so obtained were extrusion-coated to have an average thickness of 0.30 mm on a stranded wire conductor having a cross-sectional area of 0.35 $mm^2$ using a single screw extruder (cylinder diameter 30 mm, L/D=24), and the coated wire was irradiated with 150 kGy of electron beam having an accelerating voltage of 1 MeV to obtain an insulated wire.

Manufacture of a Cable

Two insulated wires obtained as described above were stranded in the form of a twisted pair with a twist pitch of 30 mm, and the inner sheath material obtained as described above was extrusion-coated to have an outer diameter of 3.4 mm thereon using a single screw extruder (barrel diameter 50 mm, L/D=24). Subsequently, the outer sheath material obtained as described above was extrusion-coated to have an outer diameter of 4.0 mm on the surface of the inner sheath using a single screw extruder (barrel diameter 50 mm, L/D=24), and then the coated wire was irradiated with 200 kGy of electron beam having an accelerating voltage of 2 MeV, to obtain cables for test.

Evaluation of the Cables

The cables manufactured as described above were evaluated with respect to the heat adhesion property, the combustion time, the low-temperature bending property and the abrasion resistance using the test procedures described below; and the results thereof are shown in Tables 1 to 6, wherein symbol "X" shows that either the heat adhesion property or the combustion time is unacceptable, symbol "○" shows that both the heat adhesion property and the combustion time are acceptable, and symbol "◎" shows that all the heat adhesion property, the combustion test and the abrasion resistance are acceptable.

(1) Heat Adhesion Property Test

The outer sheath extracted from one of the cables in a width of 5 mm was heat-adhered with PBT plague by pressing them at a temperature of 230° C. for 30 seconds. Subsequently, a peel test for the heat-adhered outer sheath with PBT was carried out at a tensile speed of 50 mm/min, and a peel strength (N/cm) was measured. It was evaluated to be acceptable if the peel strength was measured at 20 N/cm or more.

(2) Combustion Test

One of the cables placed horizontally was brought into contact with a flame (flame length 9.5 mm) of Bunsen burner for 10 seconds, and the time required for extinguishing the flame was measured. It was evaluated to be acceptable if the fire was extinguished within 30 seconds.

(3) Low-Temperature Bending Property Test

One of the cables was placed in a thermostat set at −40° C. for 180 minutes, and then wound six times over a mandrel having a same diameter as the outer diameter of the cable at the same temperature. Next, the wound cable on the mandrel was removed from the thermostat, and the crack occurrence on the outer sheath or the inner sheath was visually inspected.

(4) Abrasion Resistance Test

The abrasion resistance of the cable was measured in accordance with the [12. abrasion resistance test, (1) abrasion tape method] provided in JASO D 608-92 for a heatproof low-tension electric wire for an automobile. It was evaluated to be acceptable if the degree of abrasion resistance was measured at 10 m or more.

TABLE 1

| | Com. Ex. 1 | Com. Ex. 2 | Com. Ex. 3 | Com. Ex. 4 |
|---|---|---|---|---|
| Sheath material | | | | |
| Thermoplastic polyurethane elastomer *1 | 50 | 50 | 50 | 50 |
| Thermoplastic polyester elastomer *2 | 50 | 50 | 50 | 50 |
| Crosslinking prompter *3 | 5 | 5 | 5 | 5 |
| Melamine cyanurate *4 | 30 | 50 | 20 | |
| Magnesium hydroxide *5 | | | | 20 |
| Inner sheath material | | | | |
| Thermoplastic polyurethane elastomer *1 | 50 | 50 | 100 | 100 |
| Thermoplastic polyester elastomer *2 | 50 | 50 | | |
| Crosslinking prompter *3 | 5 | 5 | 5 | 5 |
| Melamine cyanurate *4 | 30 | | 100 | 100 |
| Magnesium hydroxide *5 | | 50 | | |
| Heat adhesion property N/cm | 22.5 | 14.8 | 30.5 | 40.2 |
| Combustion time Sec. | 42 | 26 | 62 | 300 or more |
| Low-temp.Bending prop (−40° C.) | good | good | breakage | breakage |
| Abrasion resistance m | 24.1 | 21.5 | 18.9 | 19.2 |
| Evaluation | X | X | X | X |

TABLE 2

| | Com. Ex. 5 | Com. Ex 6 | Ex. 1 | Ex. 2 |
|---|---|---|---|---|
| Sheath material | | | | |
| Thermoplastic polyurethane elastomer *1 | 50 | 50 | 50 | 50 |
| Thermoplastic polyester elastomer *2 | 50 | 50 | 50 | 50 |
| Crosslinking prompter *3 | 5 | 5 | 5 | 5 |
| Melamine cyanurate *4 | | | | 20 |
| Magnesium hydroxide *5 | | | 10 | |
| Inner sheath material | | | | |
| EVA *6 | 100 | 100 | 100 | 100 |
| EVA *7 | | | | |
| Aluminum hydroxide *8 | 100 | | | 50 |
| Magnesium hydroxide *5 | | 200 | 100 | |
| Heat adhesion property N/cm | 62.6 | 54.5 | 46.9 | 34.8 |
| Combustion time Sec. | 300 or more | 300 or more | 25 | 21 |
| Low-temp. bending prop (−40° C.) | good | breakage | good | good |
| Abrasion resistance m | 11.6 | 4.3 | 10.9 | 21.8 |
| Evaluation | X | X | ◎ | ◎ |

TABLE 3

| | Ex. 3 | Ex. 4 | Ex. 5 |
|---|---|---|---|
| Sheath material | | | |
| Thermoplastic polyurethane elastomer *1 | 50 | 50 | 50 |
| Thermoplastic polyester elastomer *2 | 50 | 50 | 50 |
| Crosslinking prompter *3 | 5 | 5 | 5 |
| Melamine cyanurate *4 | 20 | 20 | |
| Magnesium hydroxide *5 | | | 30 |

TABLE 3-continued

| | | Ex. 3 | Ex. 4 | Ex. 5 |
|---|---|---|---|---|
| Inner sheath material | | | | |
| EVA *6 | | | 100 | 100 |
| EVA *7 | | 100 | | |
| Aluminum hydroxide *8 | | 100 | 200 | 100 |
| Magnesium hydroxide *5 | | | | |
| Heat adhesion property | N/cm | 30.7 | 37.9 | 28.5 |
| combustion time | Sec. | 1 | 2 | 12 |
| Low-temp. bending prop. (−40° C.) | | good | breakage | good |
| Abrasion resistance | m | 10.2 | 5.9 | 11.0 |
| Evaluation | | ◎ | ○ | ◎ |

TABLE 4

| | | Com. Ex. 7 | Com. Ex. 8 | Ex. 7 | Ex. 8 |
|---|---|---|---|---|---|
| Sheath material | | | | | |
| Thermoplastic polyurethane elastomer *1 | | 50 | 50 | 50 | 50 |
| Thermoplastic polyester elastomer *2 | | 50 | 50 | 50 | 50 |
| Crosslinking prompter *3 | | 5 | 5 | 5 | 5 |
| Melamine cyanurate *4 | | 40 | | 10 | 10 |
| Magnesium hydroxide *5 | | | 50 | | |
| Inner sheath material | | | | | |
| EVA *6 | | 100 | 100 | 100 | 100 |
| EVA *7 | | | | | |
| Aluminum hydroxide *8 | | 100 | 100 | 150 | 125 |
| Magnesium hydroxide *5 | | | | | |
| Heat adhesion property | N/cm | 18.1 | 16.9 | 52.6 | 51.6 |
| Combustion time | Sec. | 1 | 10 | 3 | 19 |
| Low-temp. bending prop (−40° C.) | | good | good | breakage | good |
| Abrasion resistance | m | 10.6 | 9.8 | 7.4 | 8.3 |
| Evaluation | | X | X | ○ | ○ |

TABLE 5

| | | Ex. 9 | Ex. 10 | Ex. 11 | Ex. 12 | Ex. 13 |
|---|---|---|---|---|---|---|
| Sheath material | | | | | | |
| Thermoplastic polyurethane elastomer *1 | | 50 | 50 | 50 | 50 | 50 |
| Thermoplastic polyester elastomer *2 | | 50 | 50 | 50 | 50 | 50 |
| Crosslinking prompter *3 | | 5 | 5 | 5 | 5 | 5 |
| Melamine cyanurate *4 | | | | | | |
| Magnesium hydroxide *5 | | 10 | 10 | 10 | 10 | 10 |
| Inner sheath material | | | | | | |
| EVA *6 | | 100 | 100 | 100 | | |
| EEA *9 | | | | | 100 | 100 |
| Aluminum hydroxide *8 | | 100 | | | | 150 |
| Magnesium hydroxide *5 | | | 70 | | | |
| Aluminum hydroxide *11 | | | | 70 | 70 | |
| Heat adhesion property | N/cm | 54.1 | 51.3 | 53.6 | 53.1 | 55.6 |
| Combustion time | Sec. | 26 | 22 | 4 | 18 | 11 |
| Low-temp. bending prop (−40° C.) | | good | good | good | good | good |
| Abrasion resistance | m | 10.9 | 14.8 | 15.7 | 13.1 | 6.9 |
| Evaluation | | ◎ | ◎ | ◎ | ◎ | ○ |

TABLE 6

| | | Ex. 14 | Ex. 15 | Ex. 16 | Ex. 17 |
|---|---|---|---|---|---|
| Sheath material | | | | | |
| Thermoplastic polyurethane elastomer *1 | | 50 | 50 | 50 | 50 |
| Thermoplastic polyester elastomer *2 | | 50 | 50 | 50 | 50 |
| Crosslinking prompter *3 | | 5 | 5 | 5 | 5 |
| Melamine cyanurate *4 | | | | | |
| Magnesium hydroxide *5 | | 10 | 10 | 10 | 10 |
| Inner sheath material | | | | | |
| EVA *6 | | 95 | 100 | 100 | 100 |
| Acid modified polymer *10 | | | 5 | | |
| Aluminum hydroxide *11 | | 70 | 70 | 70 | 70 |
| Silane coupling agent *12 | | | 1 | | |
| Silane coupling agent *13 | | | | 1 | 1 |
| Heat adhesion property | N/cm | 54.9 | 55.1 | 52.4 | 51.5 |
| Combustion time | Sec. | 3 | 4 | 3 | 18 |
| Low-temp. bending prop (−40° C.) | | good | good | good | good |
| Abrasion resistance | m | 19.8 | 21.5 | 20.9 | 23.5 |
| Evaluation | | ◎ | ◎ | ◎ | ◎ |

*1 polyether based elastomer, JIS A hardness 85, glass transition temperature −50° C.
*2 polyether based elastomer, Shore D hardness 40, m.p. 160° C.
*3 trimethyrol propane trimethacrylate
*4 average particle diameter 1.9 μm
*5 average particle diameter 0.8 μm
*6 ethylene-vinyl acetate copolymer, vinyl acetate content 25% by weight
*7 ethylene-vinyl acetate copolymer, vinyl acetate content 19% by weight
*8 average particle diameter 1.0 μm
*9 ethylene ethylacrylate copolymer, ethylacrylate content 25% by weight
*10 ethylene acrylic ester maleic anhydride terpolymer, comonomer content 32% by weight
*11 average particle diameter 0.6 μm
*12 triethoxyvinyl silane
*13 aminopropyl triethoxy silane From the results shown in Tables 1 to 6, the following observations and conclusions can be made.

When a same material is used for both the outer sheath and the inner sheath, the flame-retardant property of the cable tends to be low. For example, even if the amount of a flame retardant used is within the range of the present invention, e.g., 35 parts by weight or less, a sufficient level of flame-retardant property can not be achieved (Comparative Example 1). Also, if the content of a flame retardant used in the outer sheath is increased (Comparative Example 2), the heat adhesion property of the cable is lowered even though the result of combustion test is acceptable. On the other hand, if the content of a flame retardant used in the inner sheath is made higher in order not to lower the heat adhesion property of the cable, the combustion test of the cable may fail (Comparative Examples 3 and 4).

Further, when a polyolefin based resin is employed to form the inner sheath, the flame-retardant property of the cable is improved (Examples 1 and 2). However, when no flame retardant is used in the outer sheath, the cable burns continuously (Comparative Examples 5 and 6). In addition, if the amount of the flame retardant contained in the outer sheath is out of the range of the present invention, e.g., more than 35 parts by weight, the heat adhesion property of the cable becomes low (Comparative Examples 7 and 8).

When a polyolefin based resin is employed to form the an inner sheath and a flame retardant is added therein in an amount within the range of the present invention, excellent flame-retardant property and heat adhesion property can be achieved (Examples). However, if the amount of the flame retardant employed in the inner sheath is more than 120 parts by weight per 100 parts by weight of the polyolefin based resin, acceptable abrasion resistance can not be achieved (Examples 8 and 13), indicating that the preferred amount of a flame retardant which may be employed in the inner sheath is 120 parts by weight or less for improving the abrasion resistance of the cable.

It is also clear that aluminum hydroxide exerts superior flame retardant effect in the inner sheath to magnesium hydroxide (see Examples 10 and 11).

Also, aluminum hydroxide having an average particle diameter of 0.6 μm provides superior flame retardant effect to that having an average particle diameter of 1.0 μm, even though a smaller amount of aluminum hydroxide used is used (see Examples 9 and 11). Therefore, it can be clearly seen from the results that the preferred average particle diameter of a flame retardant is in the range of 0.1~0.9 μm.

EEA can be used preferably as a polyolefin based resin to form the inner sheath (Example 12). However, it is clear that the use of EVA further enhances the abrasion resistance of a cable as compared with EEA (see Examples 11 and 12).

Also, it is clear that the abrasion resistance of a cable is remarkably improved when a silane coupling agent is added to the inner sheath (Examples 15 to 17).

While the invention has been shown and described with respect to the preferred embodiments, it will be understood by those skilled in the art that various changes and modifications may be made without departing from the scope of the invention as defined in the following claims.

What is claimed is:

1. A halogen free flame retardant cable comprising at least one insulated wire, an inner sheath covering the at least one insulated wire and an outer sheath covering the inner sheath, wherein the inner sheath includes a polyolefin based resin or a resin composition mainly composed of the polyolefin based resin; the outer sheath includes a crosslinked resin mixture of a thermoplastic polyurethane elastomer and a thermoplastic polyester elastomer or a crosslinked resin composition mainly composed of the mixture; the inner sheath further includes a flame retardant composed of aluminum hydroxide and/or magnesium hydroxide in an amount of 30~120 parts by weight per 100 parts by weight of the polyolefinic resin; and the outer sheath further includes a halogen free flame retardant containing nitrogen in a molecule in an amount of 3~35 parts by weight per 100 parts by weight of the resin mixture.

2. The halogen free flame retardant cable according to claim 1, wherein said at least one insulated wire is fabricated by stranding two or more insulated wires.

3. The halogen free flame retardant cable according to claim 1, wherein the inner sheath includes a flame retardant in an amount of 50~100 parts by weight per 100 parts by weight of the polyolefin based resin.

4. The halogen free flame retardant cable according to claim 1, wherein the flame retardant included in the inner sheath is aluminum hydroxide.

5. The halogen free flame retardant cable according to claim 1, wherein the flame retardant included in the inner sheath has an average particle diameter of 0.1~0.9 μm.

6. The halogen free flame retardant cable according to claim 1, wherein the polyolefin based resin included in the inner sheath is an ethylene-vinyl acetate copolymer.

7. The halogen free flame retardant cable according to claim 1, wherein the polyolefin based resin included in the inner sheath contains an acid-modified polymer.

8. The halogen free flame retardant cable according to claim 1, wherein the inner sheath further includes a silane coupling agent in an amount of 0.1~3 parts by weight per 100 parts by weight of the polyolefin based resin.

9. The halogen free flame retardant cable according to claim 1, wherein the weight ratio of the thermoplastic polyurethane elastomer to the thermoplastic polyester elastomer included in the outer sheath ranges from 20/80 to 80/20.

10. The halogen free flame retardant cable according to claim 1, wherein at least the outer sheath is cross-linked by exposing an ionizing radiation.

11. The halogen free flame retardant cable according to claim 1, wherein the amount of the flame retardant included in the outer sheath ranges from 5 to 22 parts by weight per 100 parts by weight of the resin mixture,

12. The halogen free flame retardant cable according claim 1, wherein the flame retardant included in the outer sheath is melamine cyanurate.

* * * * *